United States Patent [19]

Stull

[11] Patent Number: 4,646,947

[45] Date of Patent: Mar. 3, 1987

[54] HAND-HELD DISPENSER WITH AUTOMATIC CAP VENTING

[76] Inventor: Gene Stull, 5 Oak St., Chester, N.J. 07930

[21] Appl. No.: 797,961

[22] Filed: Nov. 14, 1985

[51] Int. Cl.[4] ..... B65D 83/00

[52] U.S. Cl. ..... 222/397; 222/520; 215/307; 137/852

[58] Field of Search ..... 222/520, 521, 546, 397, 222/396, 635, 481, 213, 214; 215/307; 137/852, 853, 855, 860, 589, 587

[56] References Cited

U.S. PATENT DOCUMENTS

| | | | |
|---|---|---|---|
| 2,769,580 | 11/1956 | Hudson et al. | 222/397 |
| 3,527,388 | 9/1970 | Cooprider | 222/397 |
| 3,918,611 | 11/1975 | Ewald | 222/396 |
| 4,231,489 | 11/1980 | Malone | 215/307 |

*Primary Examiner*—Joseph J. Rolla
*Assistant Examiner*—Kenneth Noland
*Attorney, Agent, or Firm*—H. Gibner Lehmann; K. Gibner Lehmann

[57] ABSTRACT

A hand-held dispenser for a flowable product capable of gassing, comprising a container having a neck part at its top, and a dispensing cap having a body part provided with a discharge opening. The cap-body and container-neck parts are cooperable to mount the cap on the container, and are constituted to form a cooperable automatic pressure-relief valving device which, in response to increased gas pressure in the container, vents a limited quantity of gas when the container is upright. This prevents expelling or splattering of the container contents. A first annular sealing surface on one part and a cooperable annular sealing surface on the other part effect a seal when the cap is fully seated on the container, and permit escape of gas when the cap is slightly unseated. A projection on one part is engageable with a projection on the other part to provide a biasing action which returns the cap to fully-seated position after the venting. The cap part has a unique venting passage exterior to the seal, to conduct the vented gas downward past outwardly-projecting portions of the container neck part. Either the container neck part, or the cap body part is of yieldable plastic, or both may be yieldable.

26 Claims, 5 Drawing Figures

HAND-HELD DISPENSER WITH AUTOMATIC CAP VENTING

CROSS REFERENCE TO RELATED APPLICATIONS

Copending U.S. application Ser. No. 699,306 in the name of Gene Stull, filed Feb. 7, 1985 and entitled HAND-HELD DISPENSER WITH AUTOMATIC VENTING.

BACKGROUND

This invention relates generally to hand-held dispensers for viscous or liquid products, and more particularly to dispensers of the type wherein a separate container having an upstanding neck part is fitted with a two-piece cap construction comprising a screw cap, and a cap body part, the latter being adapted for securement to the container neck part by means of retention beads, or else by screw threads. In such dispensers, the cap body part and the container normally remain together during shipping and use of the dispenser. The screw cap is usually held captive on the cap body part but is moveable thereon between closed sealing and open unsealing positions.

Dispensers of this general type are well known. Examples of such dispensers are illustrated in the following patents, which are believed to constitute a representative sample of the prior art currently in existence: U.S. Pat. Nos. 3,370,764; 3,598,285; 3,406,880; 3,407,967; 3,216,630; 3,351,249, and 3,319,843, all issued to Morton B. Stull; and U.S. Pat. No. 4,477,002, issued to Gene Stull.

The present invention constitutes another embodiment of the invention set forth in my above-identified copending application.

Dispensers of the type described and illustrated in the above patents were frequently employed with substances such as adhesives or glues of one type or another, which were for the most part, non-volatile. That is, problems caused by some of the material gasifying while still in the container were normally not encountered. Accordingly provision for dealing with build-up of excessive pressures was not made, since there was generally no necessity for doing so, and the chances of such containers bursting or breaking along a seam were minimal.

However, the invention of my copending application above identified was directed to the storage and dispensing of a product capable of gasifying to a limited extent.

In this connection it has been found that with some types of substances, namely certain foods, there can exist a strong tendency for gas to build up within the container after a period of time. The problem is especially troublesome in the category of foods which include mustards. With conventional prepared mustard packaging where an adequate tight seal was employed in order to insure the integrity of the product, there have occurred instances where the container has either burst, or else the caps thereof have been blown off by the internal pressure in the container. In the case of prepared mustard, such an occurrence represents not only a loss of the particular dispenser involved, but in addition, the contents often are splattered with considerable force against adjacent containers, giving rise to the need for removing them from the area where the accident occurred, cleaning them individually, and replacing them. The clean-up represented an unnecessary waste of time as well as being a nuisance, as can be readily appreciated.

Practically all of the present containers of which I am aware do not make provision for the automatic venting of built-up gases therein, since in general the manufacturers and distributors were more concerned with the integrity of the package, that is, making sure that the contents were not contaminated by external means, and also that no leakage of the product occurred during the interim between the filling of the dispenser and the purchase and use by the consumer.

SUMMARY

The above disadvantages and drawbacks of prior hand-held dispensers of the non-venting type are largely obviated by the present invention, which has for one object the provision of a novel and improved, automatically-venting dispenser cap or cap-container combination which is especially simple in its construction, while at the same time providing excellent protection against breakage or bursting of the container due to inadvertent build-up of pressure therein.

Another object of the invention is to provide an improved dispenser cap or cap-container combination as above outlined, wherein the venting capability is had mostly in the cap without requiring special configurations of the container or container neck part.

A related object of the invention is to provide an improved dispenser cap or cap-container combination as above set forth, wherein the integrity of the seal between the cap part and container neck part is reliably maintained under normal conditions, as where the dispenser is being stored, shipped, or used by the consumer, but which automatically and in a safe manner, momentarily relieves any pressure build-up in the container as might occur under adverse conditions, such relief being provided at a time well ahead of that which would result in explosive destruction of the container and resultant spillage or splattering the contents thereof.

Still another object of the invention is to provide an improved dispenser cap or cap-container combination as above characterized, wherein the individual parts can be economically molded of plastic substance in relatively simple cavities, thus maintaining the overall manufacturing cost as low as possible.

Yet another object of the invention is to provide an improved dispenser cap and cap-container combination of the kind indicated, wherein the assembly of the cap body part onto the container neck part can be readily carried out, preferably by automatic capping equipment, thus further reducing the overall cost of the product.

A still further object of the invention is to provide an improved dispenser cap and cap-container combination as outlined above, wherein the cap body part, once assembled to the container neck part, is reliably and permanently retained thereon with virtually no possibility of the body part being loosened, either inadvertently such as during handling or shipping, or deliberately, perhaps as the result of tampering.

The above objects are accomplished by the provision of a unique dispenser cap and hand-held dispenser container for a flowable product, characterized by the container having a neck part at its top, in combination with a cap body part having a discharge opening, said body part being cooperable with the neck part of the container to mount the cap body part thereon for limited emergency movement. The cap body and neck parts have cooperable automatic pressure-relief valving means which is responsive to increased gas pressure in the container, for venting a limited quantity of overpressure gas when the container is in its upright position, thereby to prevent possible explosion of the container and spillage or splattering of its contents.

In the illustrated embodiment of the invention there is an annular sealing surface on one part, and a cooperable annular sealing surface on the other part is sealingly engageable with the first surface when the cap body part is fully seated on the neck part. A projection on one of said parts is disposed adjacent the sealing surface thereof, and is engageable with a cooperable projection on the other part so as to effect a deformation of at least one of said projections if the cap body part is forced upward slightly from the fully seated position on the neck part. For said condition, the seal between the cap body and neck parts is at least momentarily broken, thereby enabling a limited venting of gas to occur periodically and automatically, and avoiding the possibility of excessive pressure build-up in the container. The deformation has a biasing effect, resulting in an automatic return of the cap body part to its sealing position on the container neck part as soon as pressure release is effected.

Either the cap body part can deform to its maximum extent, or the container neck part, or both can approximately equally deform.

Other features and advantages will hereinafter appear.

In the drawings, illustrating an embodiment of the invention:

Figure 1:
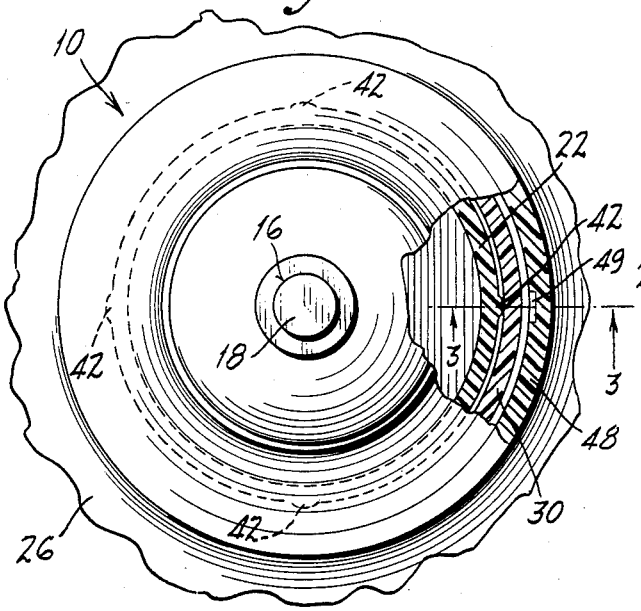
FIG. 1 is an enlarged view, partly in top plan and partly in horizontal section, of the improved automatic venting cap construction of the present invention. The section is taken on the line 1—1 of FIG. 2.
Figure 3:
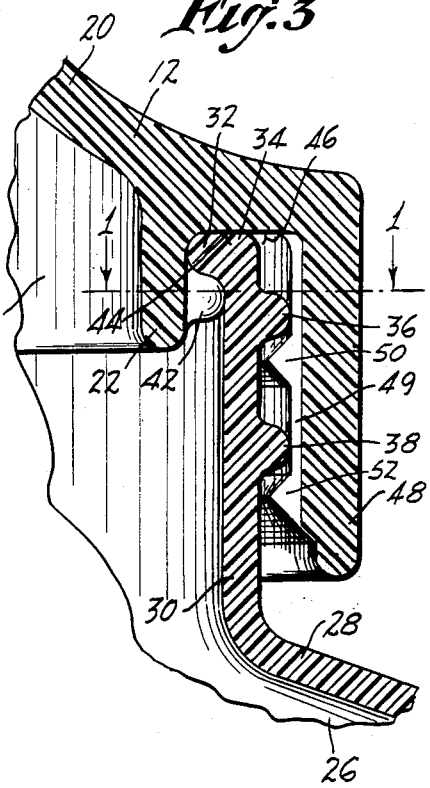
FIG. 3 is a fragmentary vertical section of the cap and container of FIGS. 1 and 2 greatly enlarged, taken on the line 3—3 of FIG. 1.
Figure 2:
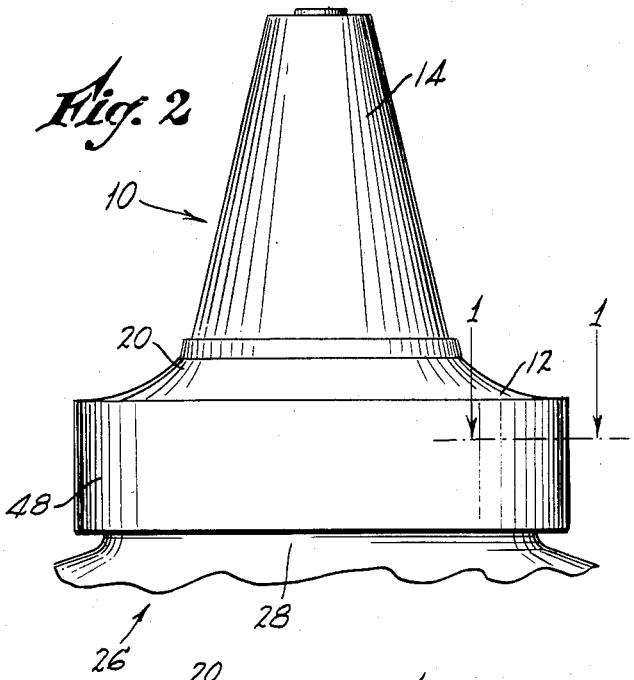
FIG. 2 is a side elevational view of the venting cap and a fragmentary side elevational view of the container construction of FIG. 1, illustrating exterior details of the structure thereof.

Referring first to FIGS. 1–3, the automatic venting dispenser construction as provided by the invention comprises a dispensing-type cap 10 having as separate pieces a body part 12 and, threaded thereon, a screw cap closure 14. The screw cap closure 14 has a discharge orifice 16 which is closed by a stopper pin 18 carried by the body part 12, in an internal configuration wherein fluid product can flow upward past the pin 18 when the screw cap 14 is unscrewed and raised. Interior details of the screw cap 14 and cooperable interior portion of the body part 12 are fully disclosed in my copending application above identified; since per se they form no part of the present invention, they have been omitted here. However, the disclosure of my identified copending application is made a part of the present application for referral thereto if desired.

As seen in FIGS. 2 and 3, the body part 12 has a conical intermediate portion 20 from which there depends a skirt 22 that defines a discharge opening 24 through which the fluid product in the container 26 can flow upward.

The container 26 at its top 28 has a neck part 30 which is provided with an internal annular protuberance or projection in the form of a bead 32 at the top rim or lip 34. On its exterior, the neck part 30 has a pair of vertically spaced-apart annular beads 36, 38, located at levels below the inner bead 32 for purposes later described. In general, such container and neck construction is already well known and widely used for various products.

In accordance with the present invention, the dispenser cap 10 is constituted in a unique manner to cooperate with the above neck part 30 for the purpose of biasing the cap normally toward a fully seated, sealing position on the container 26, and to automatically restore the cap to such sealing position if it should be slightly dislodged therefrom, as by excessive gas pressure from within the container 26.

Also, according to the invention, the dispenser cap 10 has unique means providing a gas venting passage on its inside, which remains unobstructed at all times regardless of the sealing or unsealing position of the cap.

Accordingly, as seen in FIGS. 1 and 3, the skirt 22 of the cap 10 is provided with a plurality of radially outwardly projecting segmental protuberances 42 adapted to normally underlie and to be in firm contact with the internal bead 32 of the neck part 30. The protuberances 42 are here shown as being four in number. However, either a lesser number or a greater number of such protuberances can be employed, as will be understood.

The cap 10 can be molded of resilient and yieldable plastic substance, such as polyethylene or other suitable material, and the container 26 can also be constituted of resilient plastic substance.

Figure 4:
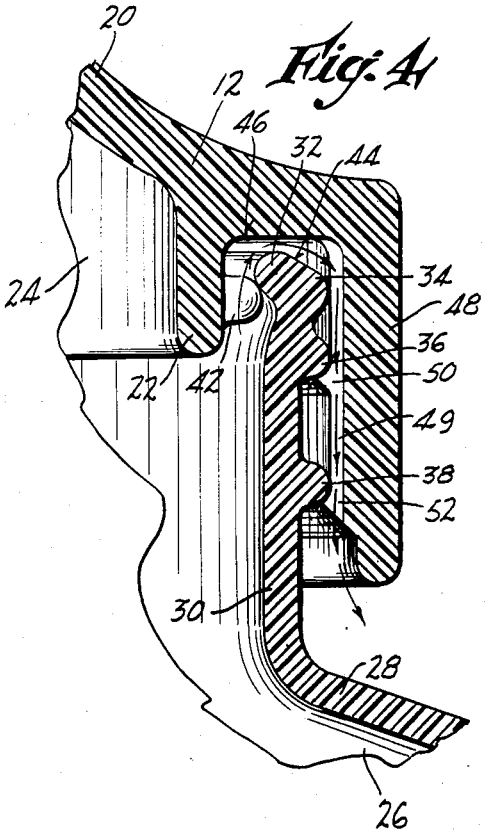
FIG. 4 is a view like that of FIG. 3 but showing the cap body part as having been raised axially upward by gas pressure in the container. Maximum deformation of the container neck part is indicated, and the seal between the cooperable sealing surfaces on the cap body part and the container neck part have momentarily separated, enabling venting of gas to occur as indicated by the arrows.

Referring now to FIGS. 3 and 4 it will be seen that the engagement of the protuberances 42 with the bead 32 of the neck part 30 will position the cap body part 12 firmly seated on the neck part 30, with cooperable sealing surfaces 44, 46 of the body and neck parts respectively in contact to prevent egress or loss of the fluid contents from the container 26. However, due to the yieldability of the plastic substances involved, an appreciable gas pressure within the container 26 can force the cap 10 upward a slight extent so as to separate the sealing surfaces 44, 46 as in FIG. 4 or FIG. 5. Thus, an automatic valving action is had, with the sealing surfaces 44, 46 and the cooperable bead 32 and protuberances 42 constituting a pressure-relief valving means.

The action of the bead 32 and protuberances 42 is such that they restore the cap 10 to the fully seated position of FIG. 3, after a relief of gas pressure has occurred during the position of FIG. 4.

As seen in FIGS. 3 and 4, the cap body part 12 is provided with an annular depending wall 48 which surrounds the neck part 30 of the container.

According to the invention, the annular wall 48 is provided with a gas-venting passage 49 which eliminates the need for any modifications to be made to existing container necks, such as the neck part 30, in enabling generated gases to escape. Also, an additional stop or limit means is provided by the invention, to limit the extent of upward movement of the cap 10 due to gas pressure relief action. In accomplishing this the wall 48 has internal annular projections or beads 50, 52 that are cooperable with the annular beads 36, 38 of the neck part 30, as seen in FIG. 4, to reliably limit the extent of permissible upward movement of the cap 10.

It should be noted that the passage 49 enables generated gas to freely bypass the beads 36, 38 on the neck part 30, and also the beads 50, 52 on the body part 12, as can be seen from an inspection of FIG. 4. Thus, no alteration is required whatsoever of the container 26 or the neck part 30 thereof, in order to effect the automatic venting and discharge of the gas as above set forth.

The showing of the deformation in FIG. 4 is exaggerated for the sake of clarity of illustration. It will be understood that only a very slight separation of the sealing surfaces 44, 46 need occur, in order for adequate venting of generated gas to take place, especially since the gas volume is small, and the rate of generation of the gas is also of little magnitude.

Figure 5:
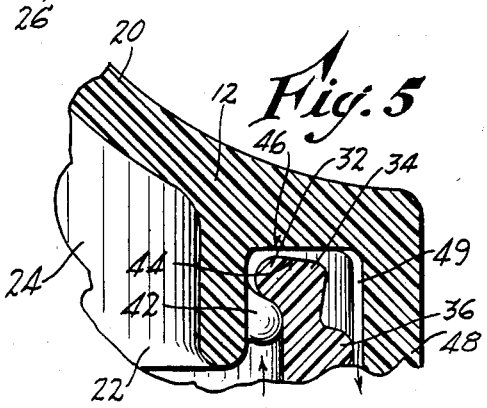
FIG. 5 is a view like that of FIG. 4 but showing a different deformation of the parts, with the cap body part deforming to the maximum extent.

The deformation illustrated in FIG. 4 is characteristic of a neck part 30 of plastic which can yield very easily, and a cap body part 12 which yields less easily. However, where the neck part 30 is relatively unyielding as compared with the cap body part 12, the latter and notably the protuberances 42 thereof will do most of the yielding, and the neck part 30 will yield much less, as seen in FIG. 5 for example.

It will now be seen from the foregoing that I have provided a novel plastic dispensing cap and container combination which has automatic pressure-relief valving means for venting gas generated in the container, such valving means involving essentially the configuration of the cap structure, with no change being required in the container 26 or neck part 30 thereof.

The cap construction, and the container neck construction are seen to be especially simple and easily fabricated by existing molding techniques, and to be straightforward and reliable in operation.

Each and every one of the appended claims is to be considered separately as to its merits with regard to the prior art, and variations and modifications of the invention are possible within the scope of the claims.

What is claimed is:

1. A hand-held dispenser for a gas-producing product capable of generating a limited gas pressure in a confined area, comprising in combination:

(a) a container for said product, having a neck part at its top, (b) a cap for said container, said cap having a body part provided with a discharge opening for said product, and said cap having means cooperable with the neck part of the container to mount the entire body part thereon for automatic movement in response to overpressure in the container from a fully-seated sealing position to an unseated, pressure-release position, (c) said body part and neck part having cooperable, pressure-relief valving means which opens in response to said overpressure movement of the body part to its unseated, pressure-release position, thereby to vent a quantity of said gas while the container is upright, said body part being automatically restored to its fully-seated position by said cooperable mounting means and said valving means thereby re-closing after said venting has occurred, (d) said mounting means retaining the cap body part captive on the neck part at all times, irrespective to relative movement between the said parts.

2. The invention as set forth in claim 1, wherein:

(a) said valving means comprises an annular sealing surface on one of said parts and a cooperable annular sealing surface on the other of said parts, engageable with the sealing surface on said one part when the cap body part is fully seated on the container neck part, and (b) a protuberance disposed on one of said parts adjacent the sealing surface thereof, said protuberance being adjacent to the sealing surface on the other of said parts and effecting a deformation of said surface on the other of said parts when the cap body part is moved from its fully-seated sealing position such that the seal between said parts is broken, thereby enabling said venting to occur.

3. The invention as set forth in claim 1, wherein:

(a) said body part has means providing a venting passage connected with a sealing surface thereof and adapted to remain unobstructed for the flow of gas when the body part is in both the said fully seated and the said unseated positions on the container neck part.

4. The invention as set forth in claim 1, and further including:

(a) means biasing the said body part at all times toward its seated, sealing position on the container neck part.

5. The invention as set forth in claim 1, wherein:

(a) said cap body part moves as a unit on said neck part in response to overpressure in the container.

6. A hand-held dispenser for a gas-producing product capable of generating a limited gas pressure in a confined area, comprising in combination:

(a) a container for said product, having a neck part at its top, (b) a cap for said container, said cap having a body part provided with a discharge opening for said product, and said cap having means cooperable with the neck part of the container to mount the body part thereon for movement between a fully-seated sealing position and an unseated, pressure-release position, (c) said body part and neck part having cooperable, pressure-relief valving means responsive to increased gas pressure in the container and consequent movement of the body part to its unseated, pressure-release position for automatically venting a quantity of said gas while the container is upright, and (d) means biasing the said body part at all times toward its seated, sealing position on the container neck part, (e) said biasing means comprises interfering, cooperable protuberances on the body part of the capand a protuberance on the container neck part, respectively, adapted for engagement with each other.

7. The invention as set forth in claim 6 wherein:

(a) a protuberance on the neck part is disposed inside the lip thereof.

8. The invention as set forth in claim 6 wherein:

(a) a protuberance on the neck part is disposed on the lip thereof.

9. The invention as set forth in claim 6 wherein:

(a) a protuberance on the body part comprises a segmental portion thereof, and
(b) a protuberance on the container neck part comprises an annular shoulder thereof, engaged with said segmental portion of the body part.

10. The invention as set forth in claim 6, wherein:
(a) a protuberance on one of said parts comprises a segmental portion thereof,
(b) a protuberance on the other of said parts comprising an annular shoulder thereof, engaged with said segmental portion of said one part.

11. The invention as set forth in claim 6, wherein:
(a) a protuberance on the neck part is disposed on the interior of said part, and
(b) a protuberance on the body part projects in a radially outward direction.

12. The invention as set forth in claim 11, wherein:
(a) a protuberance on the body part engages an inner surface of the neck part.

13. A closure adapted to be used on a hand-held dispenser for a gas-producing product which is capable of generating a limited gas pressure therein, comprising in combination:
(a) a cap having a body part provided with a discharge opening for said product, and having means adapted for cooperation with a neck part of a container to mount the body part thereon for movement between a fully-seated sealing position and an unseated, pressure-release position,
(b) said body part having an annular sealing surface adapted to engage and cooperate with an opposing annular sealing surface on a container neck part to effect a seal therewith when the body part is in the fully-seated sealing position on the container neck part, and to enable gas from the container to flow past the said annular surfaces when the body part is in its unseated, pressure-release position,
(c) said body part having a venting passage which connects with said annular sealing surface on the body part, and
(d) said venting passage being adapted to remain unobstructed for the free flow of gas therethrough when the body part is in both the said fully-seated and the said unseated positions on a container neck part whereby movement of the body part to its unseated position enables gas in the container to be vented therefrom through said venting passage.

14. The invention as set forth in claim 13, and further including:
(a) a biasing structure on the said body part, adapted to cooperate with a container neck part to urge the body part at all times toward its fully seated, captive sealing position on the container neck part,
(b) said biasing structure comprising a protuberance on the body part, adapted for engagement with a container neck part.

15. The invention as set forth in claim 14, wherein:
(a) the protuberance on the body part adjoins the said annular sealing surface thereof.

16. The invention as set forth in claim 13, and further including:
(a) a structure on the body part, adapted to cooperate with a container neck part to automatically shift the body part from an unseated, captive pressure-release position on a container neck part to a captive seated, sealing position after a venting of gas has occurred.

17. The invention as set forth in claim 13, wherein:
(a) said body part has an annular wall adapted to surround the neck part,
(b) said annular wall having the said venting passage.

18. The invention as set forth in claim 12, wherein:
(a) the annular wall of the body part has an inward projection adapted to engage the outside of the neck part to effect a retention of the body part thereon.

19. A closure adapted to be used on a hand-held dispenser for a gas-producing product which is capable of generating a limited gas pressure therein, comprising in combination:
(a) a cap having a body part provided with a discharge opening for said product, and having means adapted for cooperation with the neck part of a container to mount the body part thereon for movement between a captive fully-seated sealing position and a captive unseated, pressure-release position,
(b) said body part having an annular sealing surface adapted to engage and cooperate with an opposing annular sealing surface on a container neck part to effect a seal therewith when the body part is in the fully seated sealing position on the container neck part, and to enable gas from the container to flow past the said annular surface of the neck part when the body part is in its unseated, captive pressure-release position,
(c) said body part having a venting passage which connects with said annular sealing surface on the body part,
(d) said venting passage being adapted to remain unobstructed for the free flow of gas therethrough when the body part is in both the said fully-seated and the said unseated positions on a container neck part whereby movement of the body part to its unseated position enables gas in the container to be vented therefrom through said venting passage, and
(e) a biasing structure on the said body part, adapted to cooperate with a container neck part to urge the body part at all times toward its fully-seated, captive sealing position on the container neck part,
(f) said biasing structure comprising a protuberance on the body part, adapted for engagement with a container neck part,
(g) said body part having a depending skirt adapted to telescopically fit the neck part,
(h) said protuberance being carried by said skirt.

20. The invention as set forth in claim 19 wherein:
(a) said skirt is adapted to fit within the neck part,
(b) said protuberance on the skirt projecting radially outward therefrom for engagement by the said neck part.

21. A hand-held dispenser for a gas-producing product capable of generating a limited gas pressure in a confined area, comprising in combination:
(a) a container for said product, having a neck part at its top,
(b) a cap for said container, said cap having a body part provided with a discharge opening for said product, and said cap having means cooperable with a neck part of the container to mount the body part thereon for movement between a fully-seated sealing position and an unseated, pressure-release position, (c) resilient means on said container neck part and body part, continuously biasing the latter toward its fully-seated position, (d) pressure-relief valve means responsive to increased gas pressure in the container, enabling momentary movement of the body part in its entirety toward its unseated, pressure-release position for automatically venting a quantity of said gas while the container is upright, and (e) positive retaining means on said container neck part and body part, for holding the latter captive and preventing its inadvertent removal at such times as venting is occurring.

22. The invention as set forth in claim 21, and further including:

(a) means on the inner surface of the cap body part and facing the outer surface of the container neck part, defining a vent passage providing for free flow of gas substantially from the location of the lip of the container neck part to the exterior of the container regardless of the axial position of the body part on the said neck part.

23. The invention as set forth in claim 21, wherein:

(a) said positive retaining means comprises interfering protuberances respectively on the outside of the neck part and the inside of the body part.

24. A hand-held dispenser for a gas-producing product capable of generating a limited gas pressure in a confined area, comprising in combination:

(a) a container for said product, having a neck part at its top, (b) a cap for said container, said cap having a body part provided with a discharge opening for said product, and said cap having means cooperable with the neck part of the container to mount the body part thereon for movement between a fully-seated sealing position and an unseated, pressure-release position, (c) said body part and neck part having cooperable, pressure-relief valving means responsive to increased gas pressure in the container and consequent movement of the body part to its unseated, pressure-release position for automatically venting a quantity of said gas while the container is upright, and (d) means biasing the said body part at all times toward its seated, sealing position on the container neck part, (e) said biasing means comprises a plurality of protuberances on the body part of the cap, and a protuberance on the container neck part, adapted for engagement with the protuberances on the body part.

25. A hand-held dispenser for a gas-producing product capable of generating a limited gas pressure in a confined area, comprising in combination:

(a) a container for said product, having a neck part at its top, (b) a cap for said container, said cap having a body part provided with a discharge opening for said product, and said cap having means cooperable with the neck of the container to mount the body part thereon for movement between a fully-seated sealing position and an unseated, pressure-release position, (c) said body part and neck part having cooperable, pressure-relief valving means responsive to increased gas pressure in the container and consequent movement of the body part to its unseated, pressure-release position for automatically venting a quantity of said gas while the container is upright, and (d) means biasing the said body part at all times toward its seated, sealing position on the container neck part, (e) said biasing means comprising a protuberance on one of said parts and a plurality of protuberances on the other part, engageable with the said protuberance of the one part, (f) said protuberances being in interfering cooperable relation with each other.

26. A closure adapted to be used on a hand-held dispenser for a gas-producing product which is capable of generating a limited gas pressure therein, comprising in combination:

(a) a cap having a body part provided with a discharge opening for said product, and having means adapted for cooperation with the neck part of a container to mount the body part thereon for movement between a captive fully-seated sealing position and a captive unseated, pressure-release position, (b) said body part having an annular sealing surface adapted to engage and cooperate with an opposing annular sealing surface on a container neck part to effect a seal therewith when the body part is in the fully seated sealing position on the container neck part, and to enable gas from the container to flow past the said annular surfaces when the body part is in its unseated, captive pressure-release position, (c) said body part having a venting passage which connects with said annular sealing surface on the body part, (d) said venting passage being adapted to remain unobstructed for the free flow of gas therethrough when the body part is in both the said fully-seated and the said unseated positions on a container neck part whereby movement of the body part to its unseated position enables gas in the container to be vented therefrom through said venting passage, (e) a biasing structure on the said body part, adapted to cooperate with a container neck part to urge the body part at all times toward its fully-seated, captive sealing position on the container neck part, (f) said biasing structure comprising a protuberance on the body part, adapted for engagement with a container neck part, and (g) at least one additional protuberance on the body part, also adapted for engagement with the neck part.

* * * * *